US009777977B1

(12) United States Patent
Makaron

(10) Patent No.: US 9,777,977 B1
(45) Date of Patent: Oct. 3, 2017

(54) METHOD AND DEVICE FOR FACILITATING DISASSEMBLY OF A FIREARM AND RELEASE OF A MAGAZINE

(71) Applicant: Create Inc., Las Vegas, NV (US)

(72) Inventor: Edward Makaron, Las Vegas, NV (US)

(73) Assignee: Create, Inc., Las Vegas, NV (US)

( * ) Notice: Subject to any disclaimer, the term of this patent is extended or adjusted under 35 U.S.C. 154(b) by 0 days.

(21) Appl. No.: 15/352,146

(22) Filed: Nov. 15, 2016

(51) Int. Cl.

| | |
|---|---|
| ***F41A 9/61*** | (2006.01) |
| ***F41A 11/00*** | (2006.01) |
| ***F41A 3/66*** | (2006.01) |
| ***F41A 3/72*** | (2006.01) |
| ***F41A 9/59*** | (2006.01) |

(52) U.S. Cl.
CPC ..... *F41A 11/00* (2013.01); *F41A 3/66* (2013.01); *F41A 3/72* (2013.01); *F41A 9/59* (2013.01)

(58) Field of Classification Search
CPC .... F41A 11/00; F41A 3/66; F41A 3/72; F41A 9/59
USPC ..... 42/6
See application file for complete search history.

(56) References Cited

U.S. PATENT DOCUMENTS 4,275,640 A * 6/1981 Wilhelm ..... F41A 19/13 42/69.03
6,212,814 B1 * 4/2001 Lambie ..... F41A 11/02 42/75.03
9,057,577 B2 * 6/2015 Hannan ..... F41A 33/00
9,194,638 B2 * 11/2015 Larson, Jr. ..... F41A 17/38
2011/0271827 A1 * 11/2011 Larson ..... F41A 5/28 89/193
2014/0230297 A1 * 8/2014 Larson, Jr. ..... F41A 17/38 42/6

* cited by examiner

*Primary Examiner* — Samir Abdosh
(74) *Attorney, Agent, or Firm* — Yuri L. Eliezer; Bekiares Eliezer LLP

(57) ABSTRACT

Disclosed is a device for facilitating disassembly of a firearm and release of a magazine removably attached to the firearm. The device comprising a fulcrum configured to be attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism. Further, the device includes a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism.

23 Claims, 15 Drawing Sheets

METHOD AND DEVICE FOR FACILITATING DISASSEMBLY OF A FIREARM AND RELEASE OF A MAGAZINE

FIELD OF THE INVENTION

The invention generally relates to firearms. More specifically, the invention relates to a method and a device for facilitating changing magazines of firearms.

BACKGROUND

Firearms are barreled weapons that launch projectiles, often driven by the action of an explosive force. Firearms are often categorized by the type of action employed. For example, the type of action may include one or more of bolt action, pump action, lever arm action, single shot action, semi-automatic action and automatic action.

A semi-automatic, or self-loading, firearm is one of the most popular firearms in the United States. A semi-automatic firearm performs all steps necessary to prepare it to discharge again after firing—assuming cartridges remain in the firearm's feed device. Typically, this includes extracting and ejecting the spent cartridge case from the firing chamber, re-cocking the firing mechanism, and loading a new cartridge into the firing chamber.

Most governments across the world regulate the firearms for civilian use. The regulations may include firearm safety and storage; penalties for the unlawful possession and misuse of firearms; a licensing system to prevent undesirable persons from owning firearms; exemption from criminal liability to promote the surrender by citizens of illegal, unsafe or unwanted guns; and, a record-keeping system to track civilian firearms.

The regulation regarding firearm safety may place restrictions on the firearm design. For example, various state legislatures in the US are limiting the use of semi-automatic firearms. One such restriction targets AR-15 (a popular semi-automatic firearm) users by making it more difficult for them to change magazines. Conventionally, an unrestricted user of the AR-15 rifle may press a magazine release button on the firearm to change magazines. The release button drops the magazine out of the gun, and allows the user to input a new one. To comply with various state restrictions, AR-15 owners have installed a bullet button and can thereby be considered to otherwise convert a "detachable magazine weapon" to a "fixed magazine weapon," thus making it no longer applicable to the regulations.

Further, new laws in some states may render the use bullet button as insufficient restriction. For example, in California, beginning in January 2017, yet further restrictions leave all current AR-15 owners with a few options—They may register the firearm as an assault weapon with the state; install a device that requires an AR-15 user to disassemble the firearm prior to being able to change the magazine; or they may remove the device from the state. A per the new laws, new firearms sold in California would must come with modifications to meet these new requirements already pre-installed. Moreover, the existing owners of AR-15 cannot use their firearms without making required modifications, nor can they possess an unregistered or unmodified weapon in restrictive states.

Accordingly, it is desirable to modify the design of the firearm such that it reduces user's effort while changing magazines and at the same time abides by the new laws.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Disclosed is a device for facilitating disassembly of a firearm and release of a magazine removably attached to the firearm. The device may include a fulcrum configured to be attached to the firearm. The firearm compatible with embodiments of the present disclosure may include an upper receiver, a lower receiver, a rear takedown pin and a magazine release mechanism, wherein the rear takedown pin may be configured to secure the upper receiver to the lower receiver, wherein the magazine release mechanism may be configured to release the magazine from the firearm based on actuation of the magazine release mechanism.

Further, the device may include a lever arm configured to operationally engage with the fulcrum, wherein a first part of the lever arm may be operationally engaged with the rear takedown pin, wherein a second part of the lever arm may be operationally engaged with the magazine release mechanism, wherein actuation of the lever arm may displace the rear takedown pin and actuate the magazine release mechanism sequentially, wherein displacement of the rear takedown pin may result in disassembly of the upper receiver from the lower receiver, and wherein disassembly of the upper receiver from the lower receiver may occur prior to actuation of the magazine release mechanism.

Additionally, the device may include a limiter configured to restrict separation of the upper receiver from the lower receiver beyond a predetermined distance upon disassembly of the upper receiver from the lower receiver.

Moreover, the device may include an upper tension bar configured to be impede to the lever arm from engaging the magazine release mechanism, wherein the upper tension bar may be configured to prevent actuation of the magazine release mechanism based on actuation of the lever arm until a separation between the upper receiver and the lower receiver reaches a predetermined distance. In some embodiments, the upper tension bar may be attached to the lever arm. In other embodiments, the upper tension bar may be attached to the upper receiver.

In another aspect of the present disclosure, a method for facilitating disassembly of a firearm and release of a magazine removably attached to the firearm is disclosed. The firearm may include an upper receiver, a lower receiver, a rear takedown pin and a magazine release mechanism. The method may include receiving a first level depression of a lever arm of the firearm, wherein the firearm further comprises a device with a fulcrum and a lever arm attached to the fulcrum, wherein one end of the lever arm is near the rear takedown pin and the other end is near the magazine release mechanism. Then the method may include causing the rear takedown pin to be released, thereby partially disengaging the upper receiver from the lower receiver. Next, the method may include receiving a second level of depression of the lever arm. Finally, the method may include causing the magazine release mechanism to be activated.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
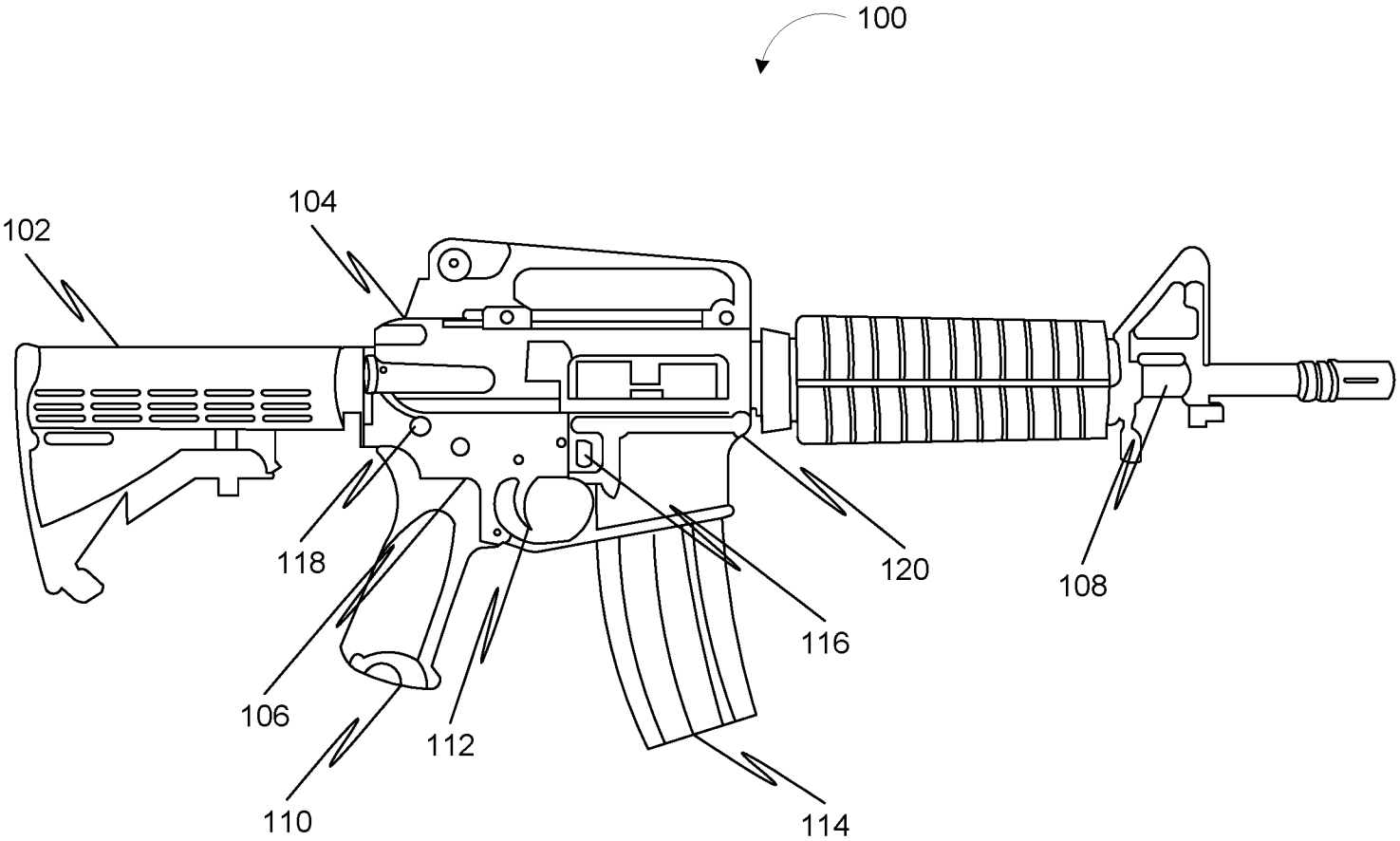
FIG. 1 illustrates a side view of a firearm according to prior art.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of the AR15, embodiments of the present disclosure are not limited to use only in this context and may be used with other weapons.

I. Overview

FIG. 1 illustrates a conventional semi-automatic firearm 100. For example, the semi-automatic firearm 100 may be AR-15. The semi-automatic firearm 100 may include a stock 102, an upper receiver 104, a lower receiver 106, and a barrel 108. Further, the lower receiver 106 may include a pistol grip 110, a trigger 112, a magazine 114, a magazine release mechanism 116, a rear takedown pin 118 and a front pivot point 120. The magazine release mechanism 116 may be one of a magazine release button and a bullet button.

Conventionally, an unrestricted user of the semi-automatic firearm 100 may press the magazine release mechanism 116 to release the magazine 114 while changing magazines. The magazine release mechanism 116 releases the magazine 114 out of the gun, and allows the user to input a new magazine.

In some jurisdictions, the law requires prohibits weapons with a removable magazine. To comply with this restriction, some owners of semi-automatic firearms have adopted a "work-around" by installing a device called bullet button which makes an otherwise removable magazine into a fixed magazine. The bullet button is designed to lock the magazine to the weapon and require a tool for unlocking the magazine. Therefore, the magazine release mechanism 116 may be replaced by a bullet button.

Figure 2:
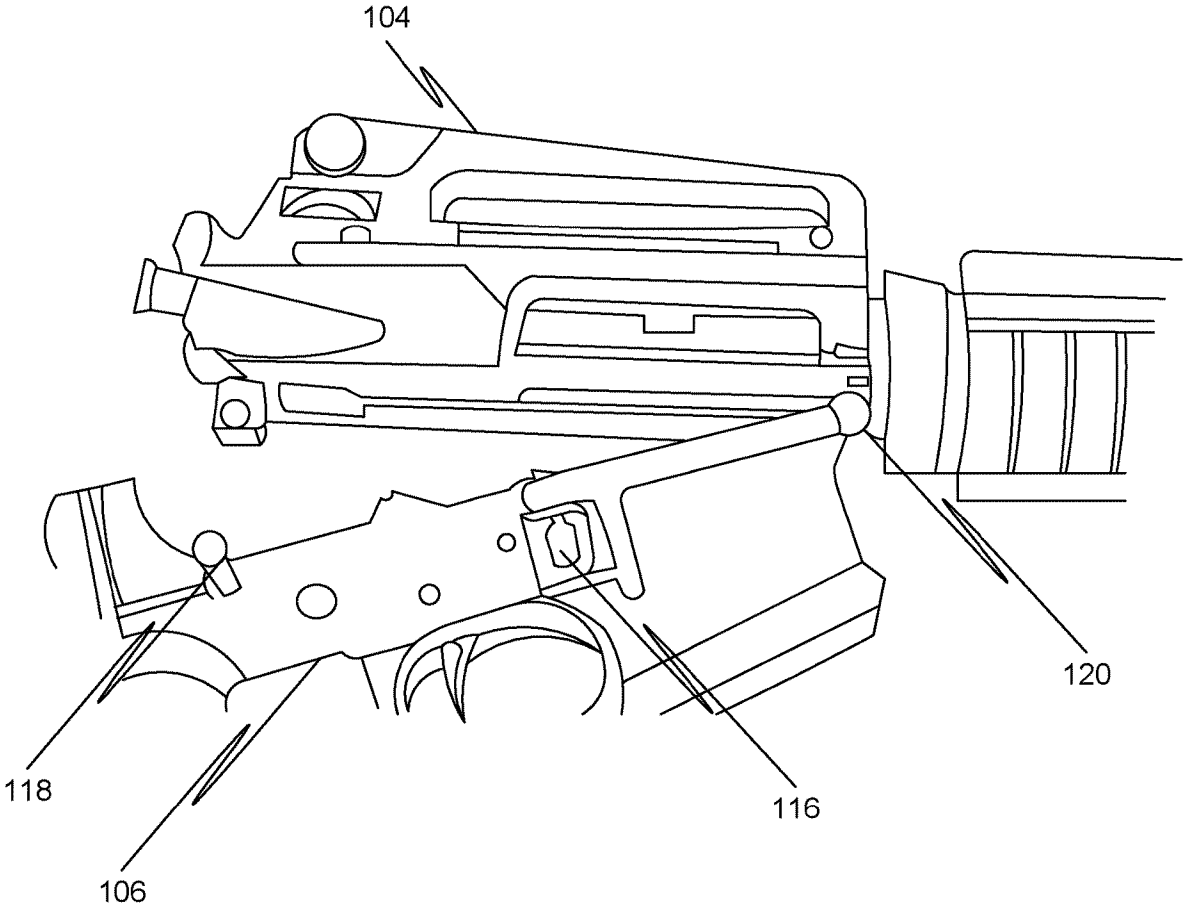
FIG. 2 illustrates a section of the firearm of FIG. 1 in disassembled state.

However, in some jurisdictions, stricter regulations classify weapons as 'fixed magazine' weapons when the weapons by further emphasizing the disassembly requirement to release the magazine. For example, the semi-automatic firearm 100 may be disassembled by pulling the rear takedown pin 118, which dislodges one end of the upper receiver 104 from the lower receiver 106 as shown in FIG. 2. Once disassembled, the upper receiver 104 may pivot on the front pivot point 120 to move away from the lower receiver 106. The process of disassembling the firearm to change the magazine makes it inconvenient for users to access, add, or remove ammunition.

According to some embodiments, the present disclosure relate to an apparatus comprising a lever arm and fulcrum-like means to enable a two-stage, contiguous motion that causes, in a first stage, a disassembly of a firearm followed by, in a second stage, the subsequent release of the magazine. The disassembly of the firearm includes separating an upper receiver of the firearm from a lower receiver of the firearm, which may prevent firing of the firearm upon pulling a trigger comprised in the firearm. It should be noted, however, that this is not a requirement in the various embodiments disclosed herein.

Further, the fulcrum may be configured to the lower receiver portion of the firearm. In various embodiments, the fulcrum may be attached to the upper receiver portion of the firearm (e.g., via the Picatinny rail system). The length of the lever arm and the configuration point of the fulcrum may be designed such that a first end of the lever arm hovers approximately over the magazine release mechanism, and a second end of the lever arm is located in proximity to a rear takedown pin configured to maintain an assembly between the upper receiver and the lower receiver.

Moreover, the second end of the lever arm may comprise a new rear takedown pin, thereby replacing the existing rear takedown pin. The length of the new rear takedown pin may be adjusted to effectuate a release of the upper receiver and the lower receiver at a smaller pin displacement setting than that of the existing rear takedown pin.

A user may press a first end of the lever arm (towards the magazine release button) to activate the lever arm and move the lever arm into an open position. The default position (or 'closed position') of the lever arm may include a second end of the lever arm resting against the rear takedown pin. Further, a spring-like mechanism may be placed between the fulcrum and the magazine release button to provide tension against the rear takedown pin, thereby keeping the lever arm in the closed position. For example, the spring-like mechanism may be placed within or near the fulcrum. The spring-like mechanism may force the lever arm into the closed position, by pushing the lever arm against the rear takedown pin. The user's pressing action may be met with a spring tension from the spring-like mechanism. The spring-like mechanism may use one of a leaf spring, coil spring, and other styled springs. In turn, once the user ceases to press on the lever, the spring-like mechanism may force the lever arm back to the closed position.

Therefore, the lever arm starts at the default, closed position. As the first end of the lever arm is depressed towards the magazine release mechanism by a user, the lever arm goes towards the open position. Further, as the first end of the lever arm is depressed towards the magazine release button, the apparatus performs two sequential functions. A first-level depression of the first end of the lever arm is configured to cause a first function, which may include a displacement of the second end of the lever arm. The displacement of the second end causes, in turn, the rear takedown pin to displace a proportional distance. The displacement of the rear takedown pin causes the upper receiver of the firearm to partially disengage from the lower receiver of the firearm. As used throughout the present disclosure, disconnect may also include disengagement of the upper receiver from the lower receiver by virtue of the rear takedown pin's removal. A second-level depression of the first end of the lever arm is configured to cause a second function subsequent to the first function, which may include activating the magazine release mechanism; for example, depressing the magazine release button. In this way, the upper receiver is disassembled from the lower receiver prior to the depression of the magazine release button.

Further, once the rear takedown pin is released, the upper receiver may not pivot about the front pivot point on its own. The weight of the upper receiver may try to pivot the upper receiver about the front pivot point; however, the user of the firearm may keep their hand on the upper receiver to prevent it from pivoting open, even after the rear takedown pin has been released. Further, since the rear takedown pin has been released, the user may press the first end of the lever arm further, thereby, depressing the magazine release button to release the magazine.

In some embodiments, an additional upper tension bar component may be positioned on the lever arm, to block the lever arm from transitioning from the first phase of depression to the second phase of depression. The upper tension bar touches the upper receiver such that when the upper receiver is raised, the tension bar may then push inward (as it is no longer blocked by the upper receiver). In some embodiments, in which the tension bar is attached to the upper receiver, the tension bar may be raised along with the displacement of the upper receiver, thereby no longer blocking the lever arm from continuation with the second phase of depression towards the magazine release button. In this way, the disclosed device prevents the magazine release until the upper receiver and lower receiver are disconnected. In further embodiments, the upper tension bar may be configured in position and length such that it must be displaced by a predetermined amount (for example, a minimum amount necessary to consider the firearm disassembled). In these embodiments, the upper tension bar may be adjusted in length and position to ensure that the upper receiver and lower receiver are disconnected by the predetermined amount.

In some embodiments, the apparatus may be coupled with a limiter. The limiter may control the maximum distance between the upper receiver and the lower receiver, when the firearm is disassembled. In various embodiments, although not always required, it may be desirable that the maximum distance may not be less than the distance necessary to prevent a hammer of the firearm from coming into contact with a firing pin upon a displacement of a trigger. In this way, the user of the disclosed device need not worry about unintentionally causing the upper receiver and lower receiver to pivot too far apart in the process of changing the magazine.

Still consistent with embodiments of the present disclosure, the end of lever arm corresponding to the magazine release button's location may be encased or enclosed so as to prevent a user's access to the magazine release button. Further still, in some embodiments, the device of the present disclosure may interface with various other magazine release button mechanisms such as, for example, but not limited to, ARMagLock™.

II. Configuration

Figure 3:
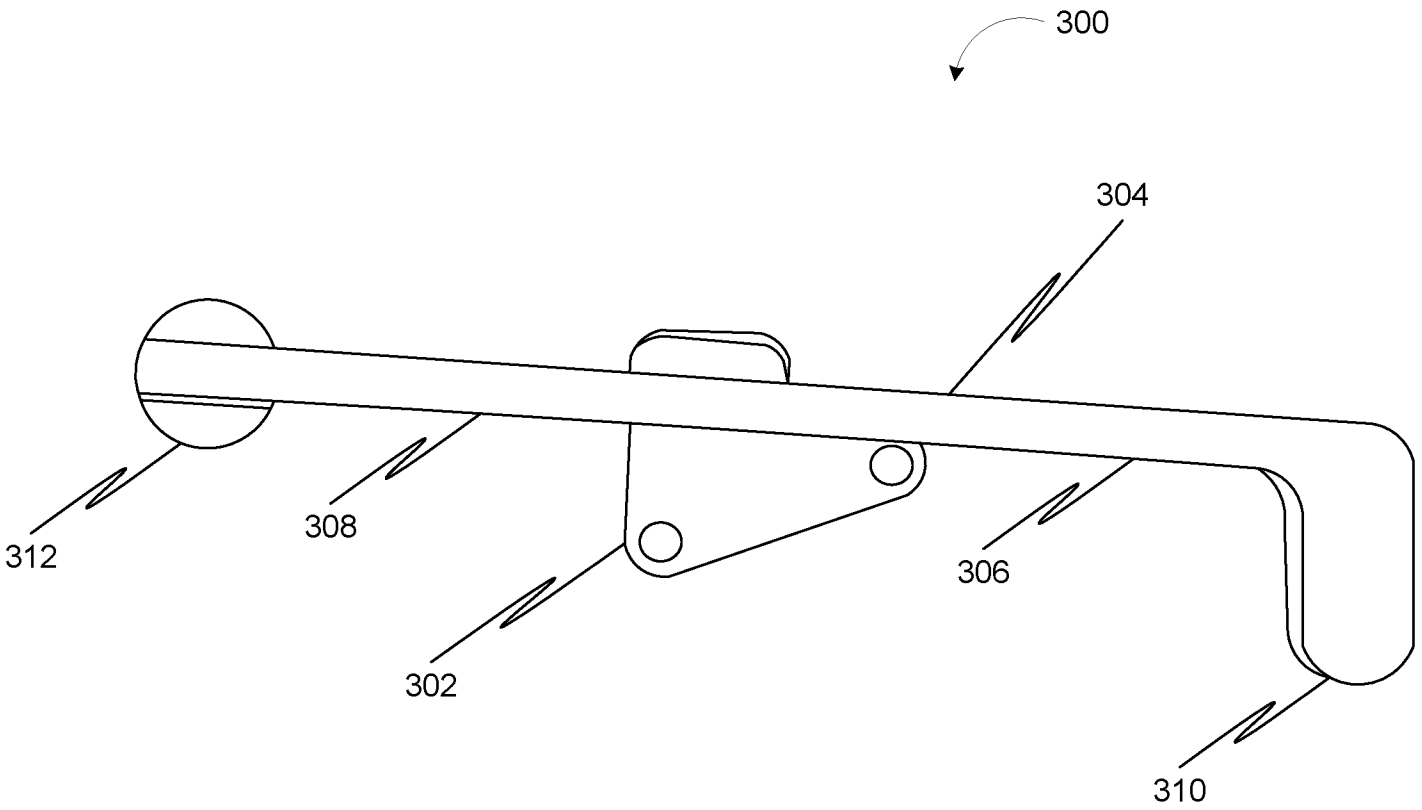
FIG. 3 illustrates a device for facilitating disassembly of a firearm and release of a magazine according to some embodiments.

FIG. 3 illustrates a side view of a device 300 configured to facilitate disassembly of the firearm 100 and release of the magazine 114 consistent with embodiments of the present disclosure. The device 300 may be installed on the firearm 100 as shown in FIG. 4.

The device 300 may include a fulcrum 302 and a lever arm 304. The fulcrum 302 may be configured to be attached to the firearm 100. Further, a spring-like mechanism (not shown) may be placed between the fulcrum 302 and the magazine release mechanism 116. For example, the spring-like mechanism may be placed within or near the fulcrum 302. The spring-like mechanism may use one of a leaf spring, coil spring, and other styled springs.

Figure 4:
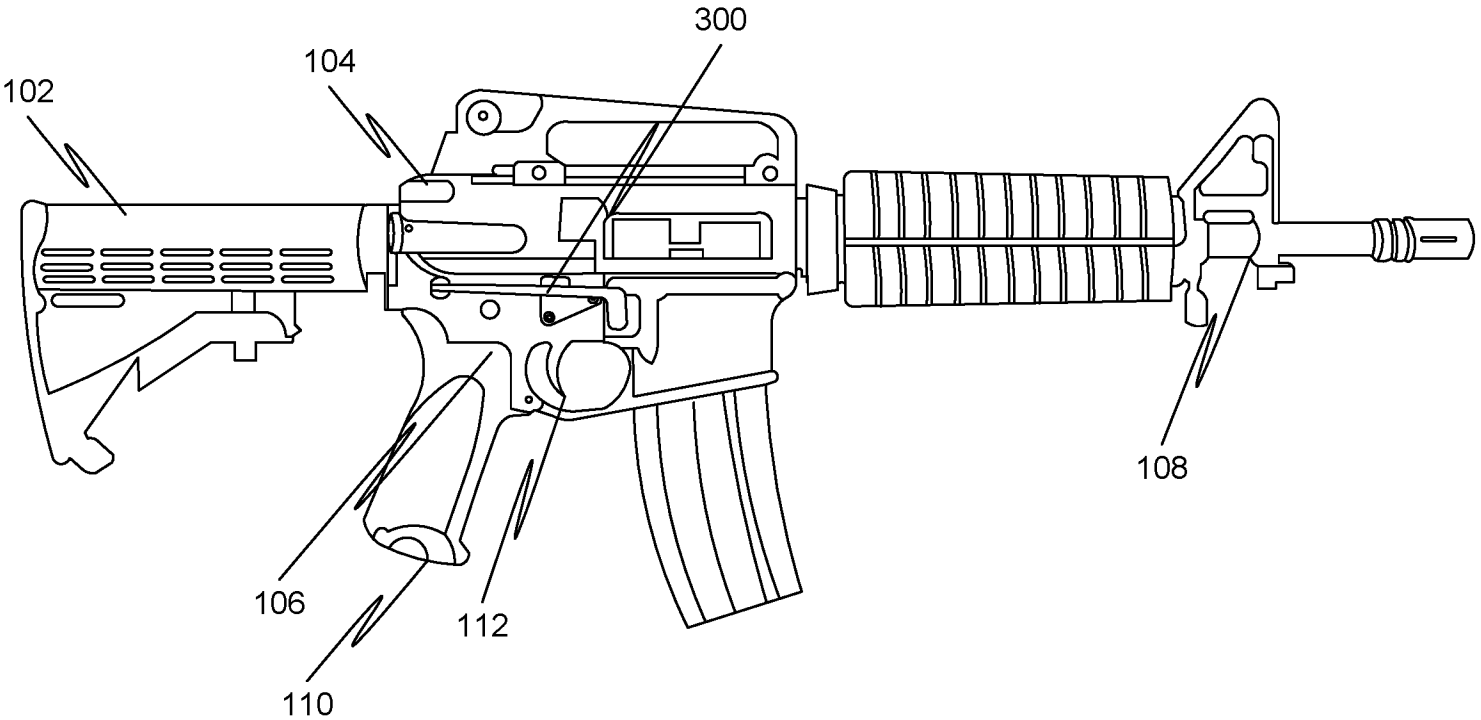
FIG. 4 illustrates the device of FIG. 3 attached to the firearm of FIG. 1 according to some embodiments.

As shown in FIG. 4, the device 300 may be attached to a side of the firearm 100. As described above, the firearm 100 may include the upper receiver 104, the lower receiver 106, the magazine release mechanism 116, the rear takedown pin 118, and the front pivot point 120. The device 300 may be installed between the magazine release mechanism 116 and the rear takedown pin 118.

The lever arm 304 may operationally engage with the fulcrum 302. The fulcrum 302 may divide the lever arm 304 into two parts, with a first part 306 on one side and a second part 308 on the other side. Further, the first part 306 may include a first end 310 of the lever arm 304. Similarly, the second part 308 of the lever arm 304 may include a second end 312 of the lever arm 304, such that the first end 310 is opposite to the second end 312. The length of the lever arm 304 and the configuration point of the fulcrum 302 may be designed such that the first end 310 of the lever arm 304 hovers approximately over the magazine release mechanism 116, and the second end 312 of the lever arm 304 is located in proximity to the rear takedown pin 118.

Figure 8:
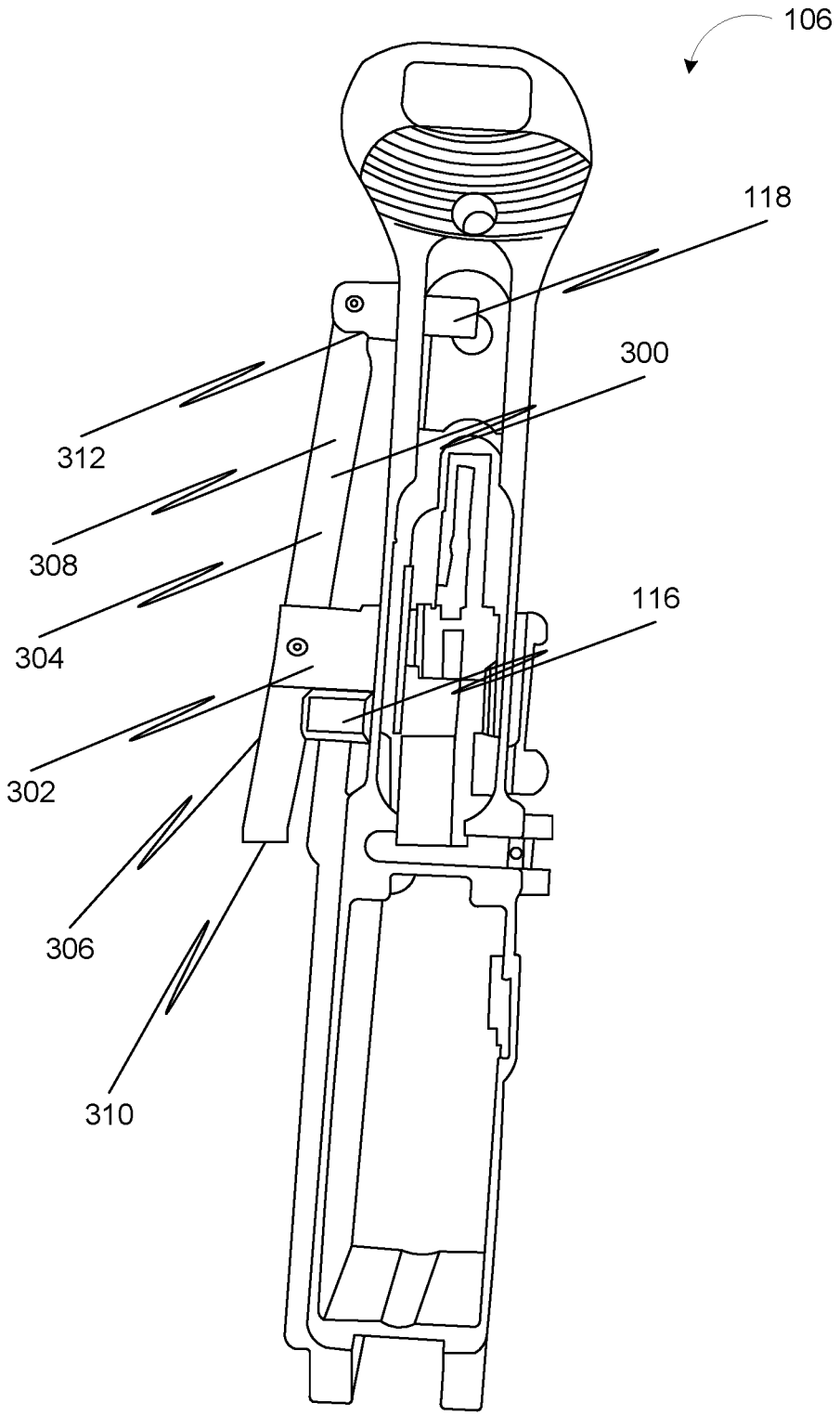
FIG. 8 illustrates a top view of the lower receiver of the firearm of FIG. 7.
Figure 9:
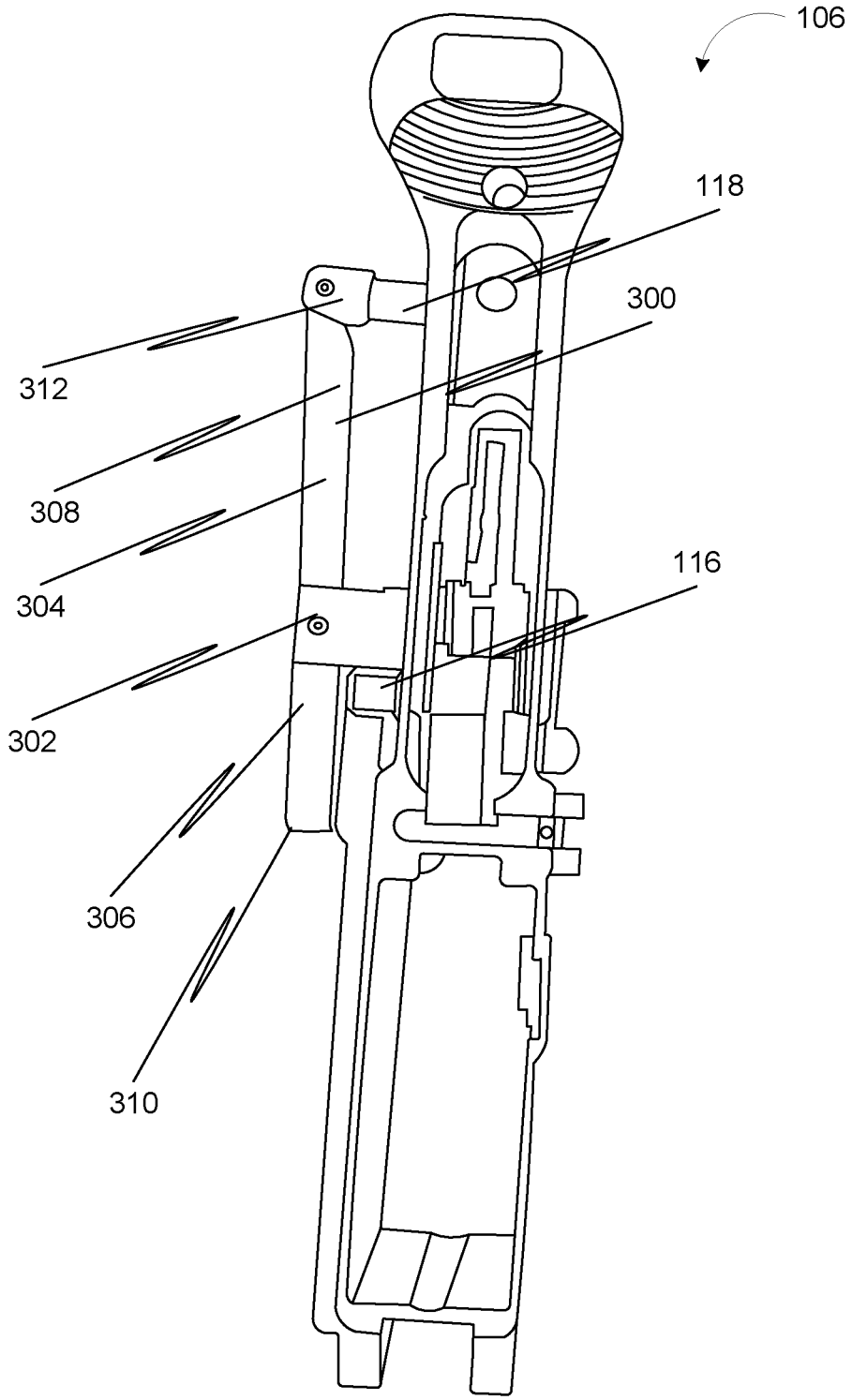
FIG. 9 illustrates a top view of the lower receiver of the firearm of FIG. 7.

Further, the first part 306 of the lever arm 304 may be operationally engaged with the magazine release mechanism 116. Moreover, the second part 308 of the lever arm 304 (specifically the second end 312) may operationally engage with the rear takedown pin 118. Alternatively, the second end 312 may include a new rear takedown pin, thereby replacing an existing rear takedown pin from the firearm 100. The new rear takedown pin 118 is shown in FIGS. 8-9. The length of the new rear takedown pin 118 may be adjusted to effectuate a release and reassembly of the upper receiver 104 and the lower receiver 106 at a smaller pin displacement setting than that of the existing rear takedown pin.

III. Operation

Figure 5:
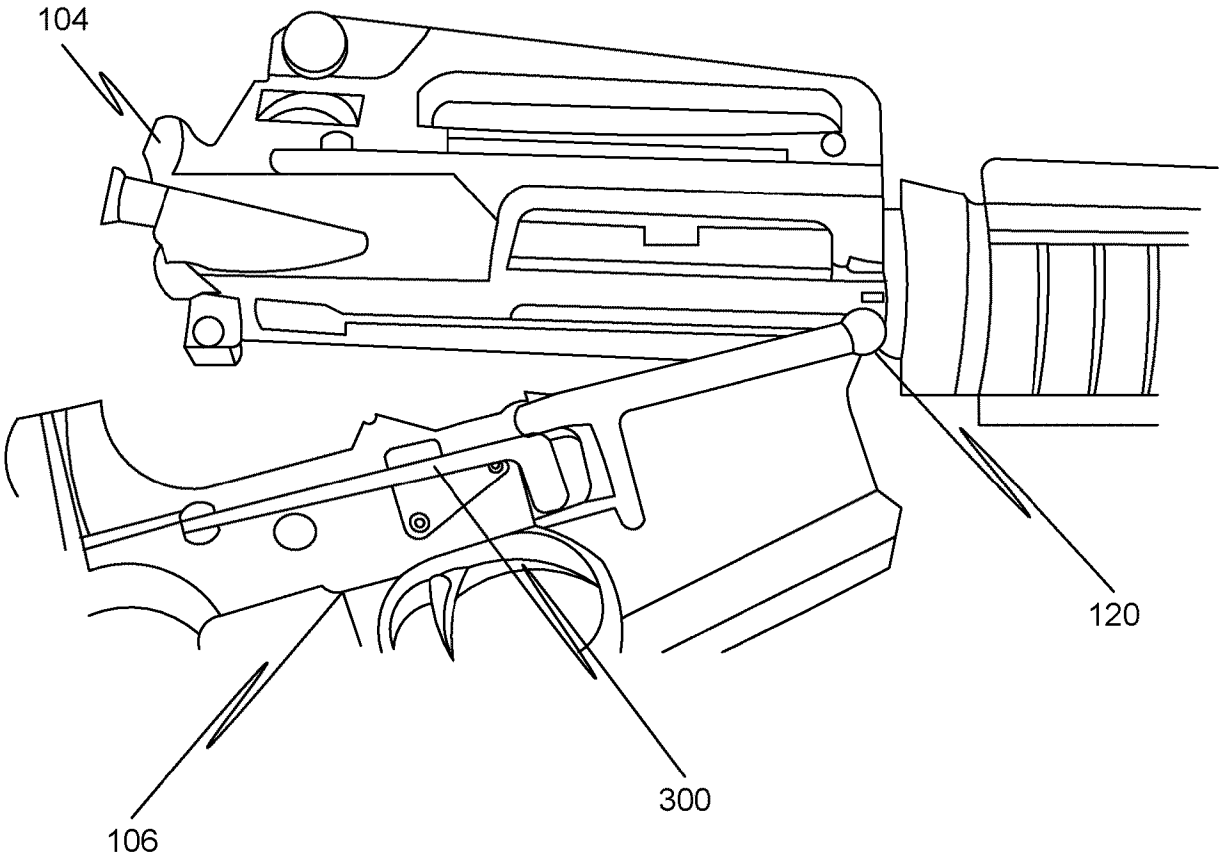
FIG. 5 illustrates a section of the firearm of FIG. 4 in disassembled state.

Further, actuation of the lever arm 304 may displace the rear takedown pin 118 and actuate the magazine release mechanism 116. The displacement of the rear takedown pin 118 may result in disassembly of the upper receiver 104 from the lower receiver 106 as shown in FIG. 5. The disassembly of the upper receiver 104 from the lower receiver 106 occurs prior to actuation of the magazine release mechanism 116.

Figure 6:
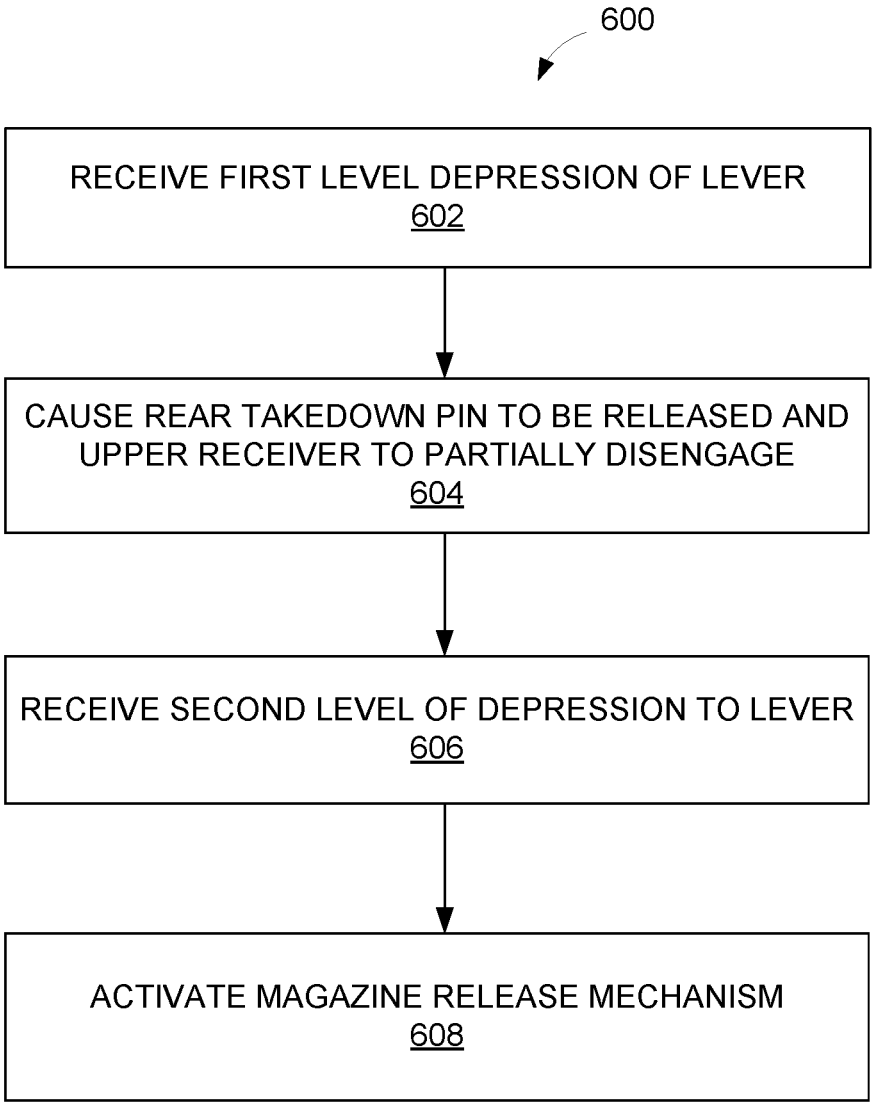
FIG. 6 is a flowchart of a method for facilitating disassembly of a firearm and release of a magazine according to some embodiments.
Figure 7:
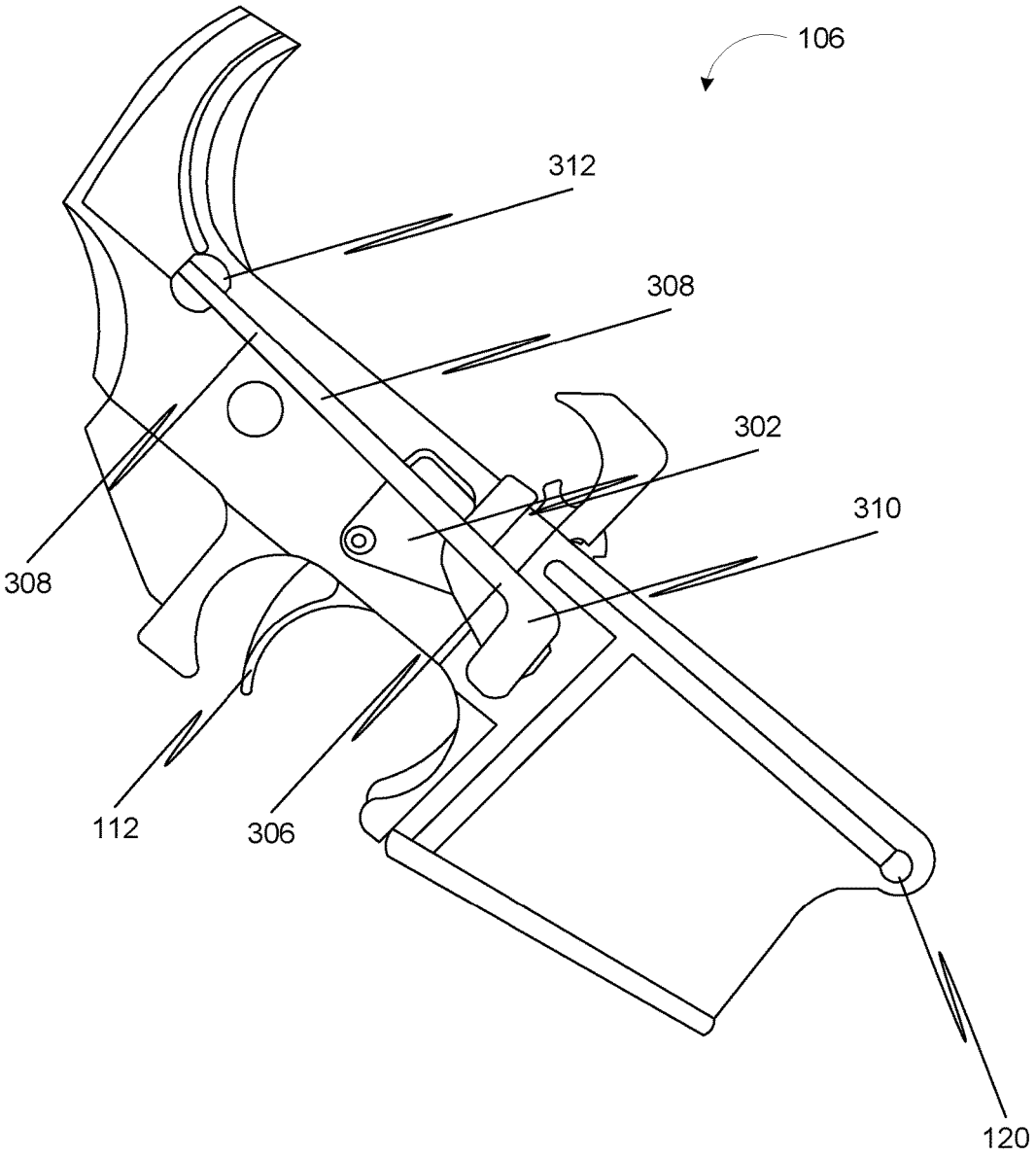
FIG. 7 illustrates a side view of a lower receiver of the firearm of FIG. 4.

FIG. 6 illustrates a method 600 for facilitating disassembly of the firearm 100 and release of the magazine 114. The lever arm 304 may be in its default position or rest position or closed position, which may include the lever arm 304 resting against the rear takedown pin 118, as shown in FIG. 7-8. FIG. 7 illustrates a side view of the lower receiver 106 with the device 300. FIG. 8 illustrates a top view of the lower receiver 106 with the device 300 in the rest state. The spring-like mechanism of the device 300 may keep the lever arm 304 in the rest position, by pushing the lever arm 304 against the rear takedown pin 118.

At 602, the method 600 includes receiving a first level depression of the lever arm 304 from a user of the firearm 100. For example, the user may press the first end 310 using their thumb to provide the first level depression of the lever arm 304. The user's pressing action may be met with a spring tension from the spring-like mechanism. In response to receiving the first level depression of the lever arm 304, the lever arm 304 may rotate on the fulcrum 302, such that the first part 306 of the lever arm 304 may move towards the firearm 100 and the second part 308 of the lever arm 304 may move away the firearm 100. The first level depression of the lever arm 304 may be configured to cause a first function, which may include a displacement of the second end 312 of the lever arm 304. At 604, the displacement of the second end causes, in turn, the rear takedown pin to displace a proportional distance to release from the firearm (as shown in FIG. 9), and lead the upper receiver 104 to disconnect from the lower receiver 106.

Thereafter, at 606, the method 600 includes receiving a second level depression of the lever arm 304 from the user. For example, the user may keep pressing the first end 310 using their thumb, after the first level depression of the lever arm 304 is received, to provide the second level depression of the lever arm 304. The second-level depression may be configured to cause a second function subsequent to the first function, which may include activating the magazine release mechanism 116, at 608. For example, the magazine release mechanism 116 may be pressed to release the magazine 114.

Therefore, the method 600 performs two sequential functions. A first function includes disassembling the firearm 100. The second function includes activating the magazine release mechanism 116. In this way, the upper receiver is disassembled from the lower receiver prior to the depression of the magazine release button. Further, the device 300 may be configured to enable disassembly of the firearm 100 and release of the magazine 114 to occur based on a single contiguous motion of the lever arm 304.

Figure 10:
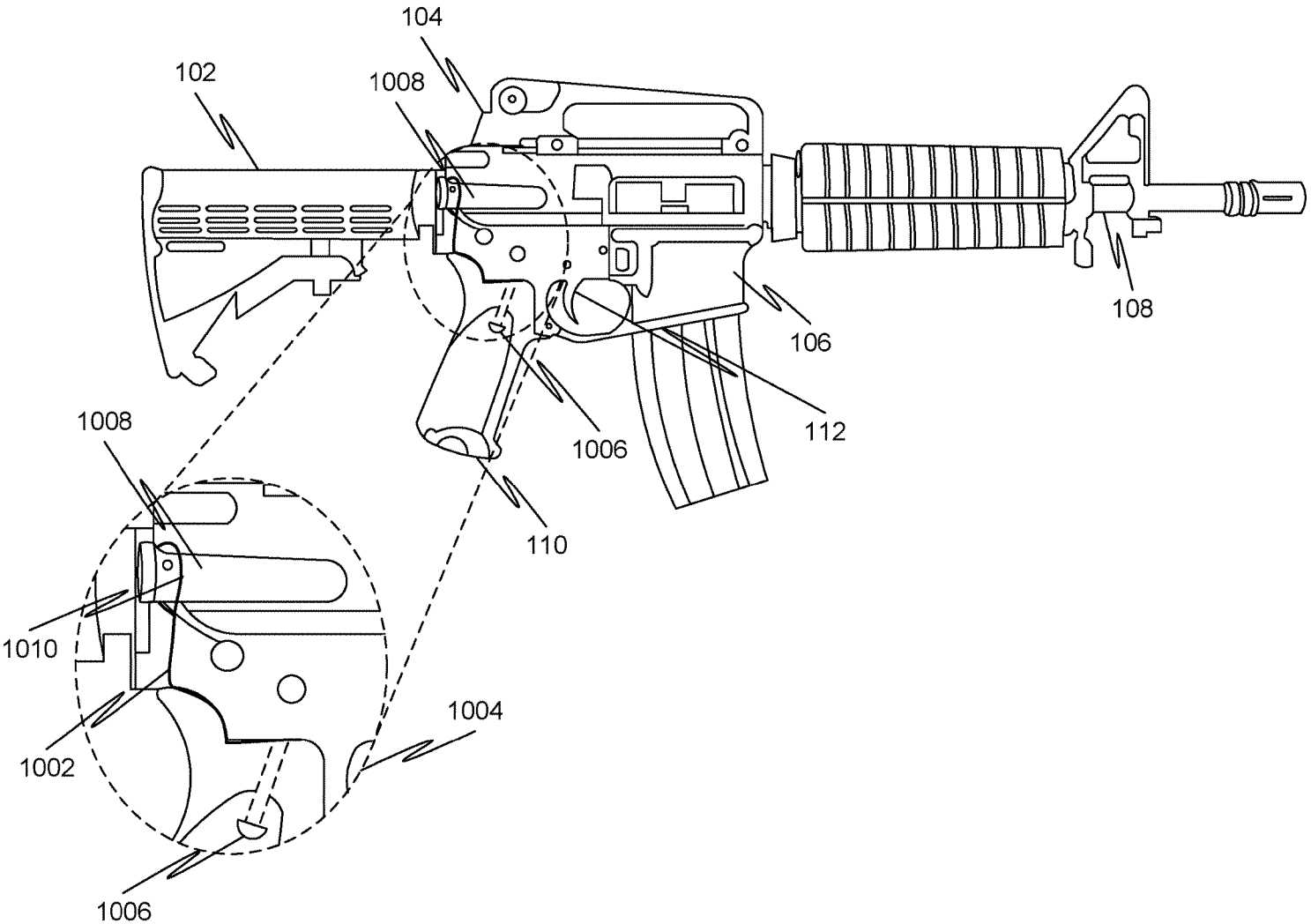
FIG. 10 illustrates a limiter attached to a firearm according to some embodiments.

According to an embodiment, FIG. 10 illustrates a side view of the firearm 100 with a limiter 1002. A circle 1004 illustrates a magnified view of the limiter 1002. The limiter 1002 may be configured to restrict separation of the upper receiver 104 from the lower receiver 106 beyond a predetermined distance upon disassembly of the upper receiver 104 from the lower receiver 106. In some embodiments, it may be desirable that the predetermined distance is more than the distance necessary to prevent a hammer (not shown) of the firearm 100 from coming into contact with a firing pin (not shown) upon a displacement of the trigger 112. Therefore, the limiter 1002 may ensure that the upper receiver 104 and lower receiver 106 do not pivot too far apart in the process of changing the magazine 114. The limiter 1002 may be one of a string wire, a plastic wire and a fabric wire. In other embodiments, the limiter 1002 may comprise a plastic piece, a composite piece, or the like. One end of the limiter 1002 may slide under the pistol grip 110, where it may be secured with a bolt 1006. The other end of the limiter 1002 may removably loop around a forward assist 1008 of the firearm 100 to form a loop 1010. The loop 1010 around the forward assist 1008 may be slipped off the forward assist 1008 when required; for example, while cleaning the firearm 100. Thereafter, the loop 1010 may be slipped back on the forward assist 1008 while using the firearm 100. Other configurations of the limiter 1002 may be possible so as to achieve the purpose of limiting the displacement between the upper receiver and the lower receiver.

In a further embodiment, a disassemble mechanism may be used to prevent actuation of the magazine release mechanism 116 based on actuation of the lever arm 304 until a separation between the upper receiver 104 and the lower receiver 106 reaches a predetermined distance. The disassemble mechanism may ensure that the firearm 100 is disassembled before the magazine release mechanism 116 is actuated. In some embodiments, disassemble mechanism may comprise an upper tension bar may be attached to the lever arm. The upper tension bar will be configured to protrude from the lever towards the upper receiver. Thus, when the lever is depressed to a certain point (prior to actuation of the magazine release mechanism), the upper tension bar's protrusion will then rest against the upper receiver, thereby block any further depression of the lever beyond the certain point.

In other embodiments, the upper tension bar may be attached to the upper receiver. In this way, when the lever is depressed to a certain point, the upper tension bar's protrusion against the upper receiver will block any further depression of the lever. When the upper receiver is displaced during disassembly, the upper tension bar will displace along with the upper receiver, thereby unblocking the depression point of the lever. In some embodiments, the location of the upper tension bar's point of contact with the upper receiver may be adjusted such that the upper receiver is required to open a predetermined distance prior to unblocking the upper tension bar. In this way, the upper tension bar will continue to block the lever arm's depression until the upper receiver has been sufficiently displaced from the lower receiver.

Figure 11:
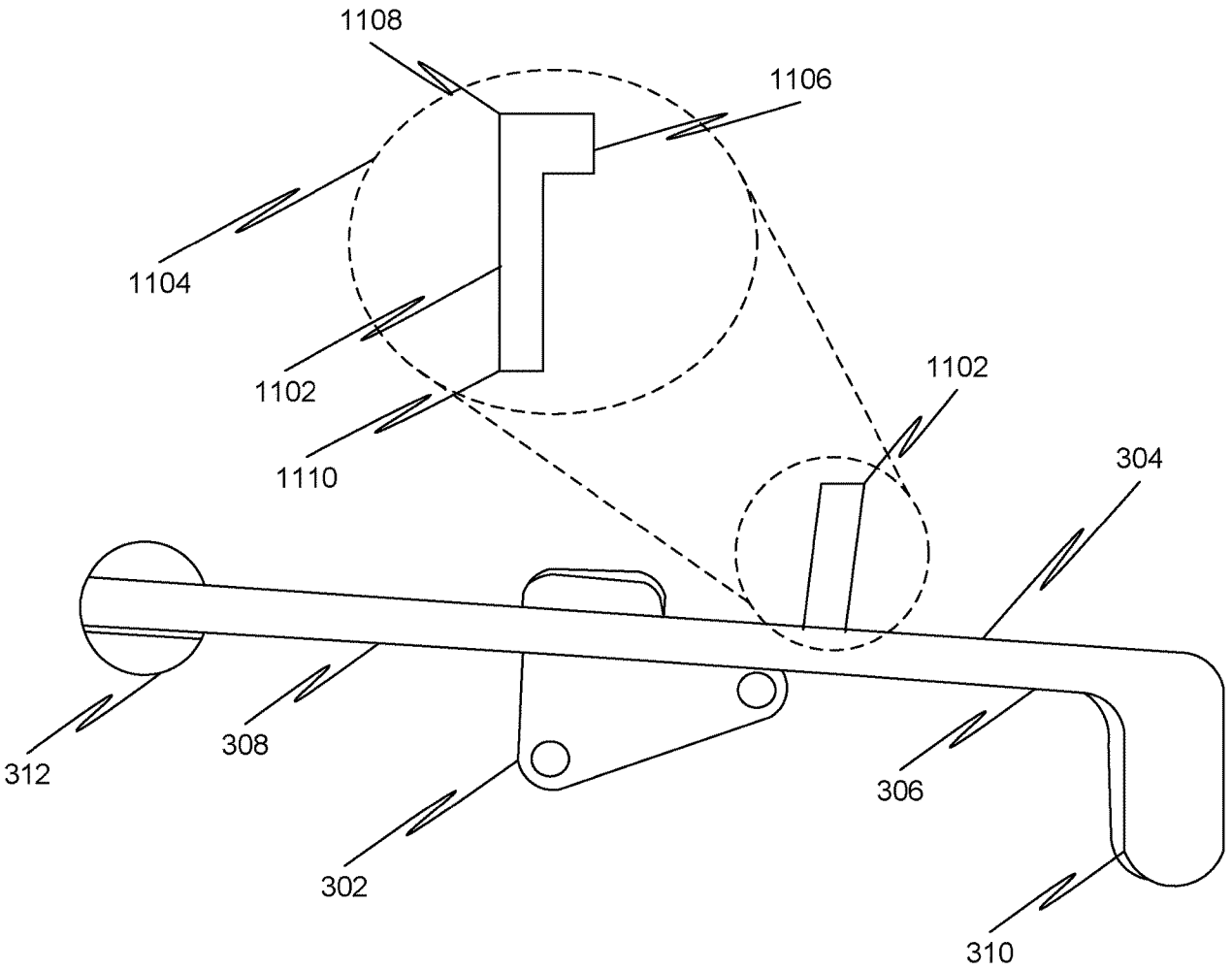
FIG. 11 illustrates a device for facilitating disassembly of a firearm and release of a magazine according to some embodiments.
Figure 12:
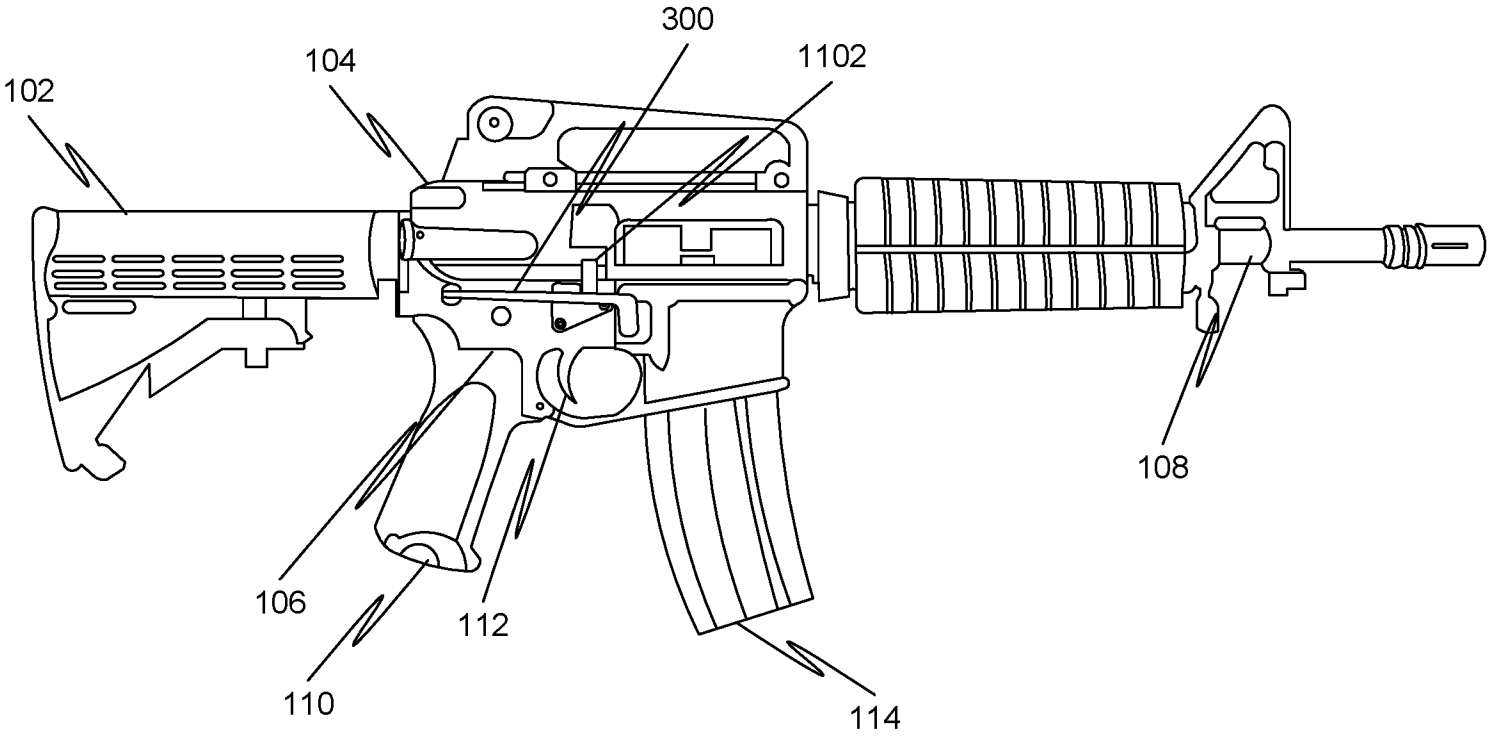
FIG. 12 illustrates the device of FIG. 11 attached to a firearm according to some embodiments.
Figure 13:
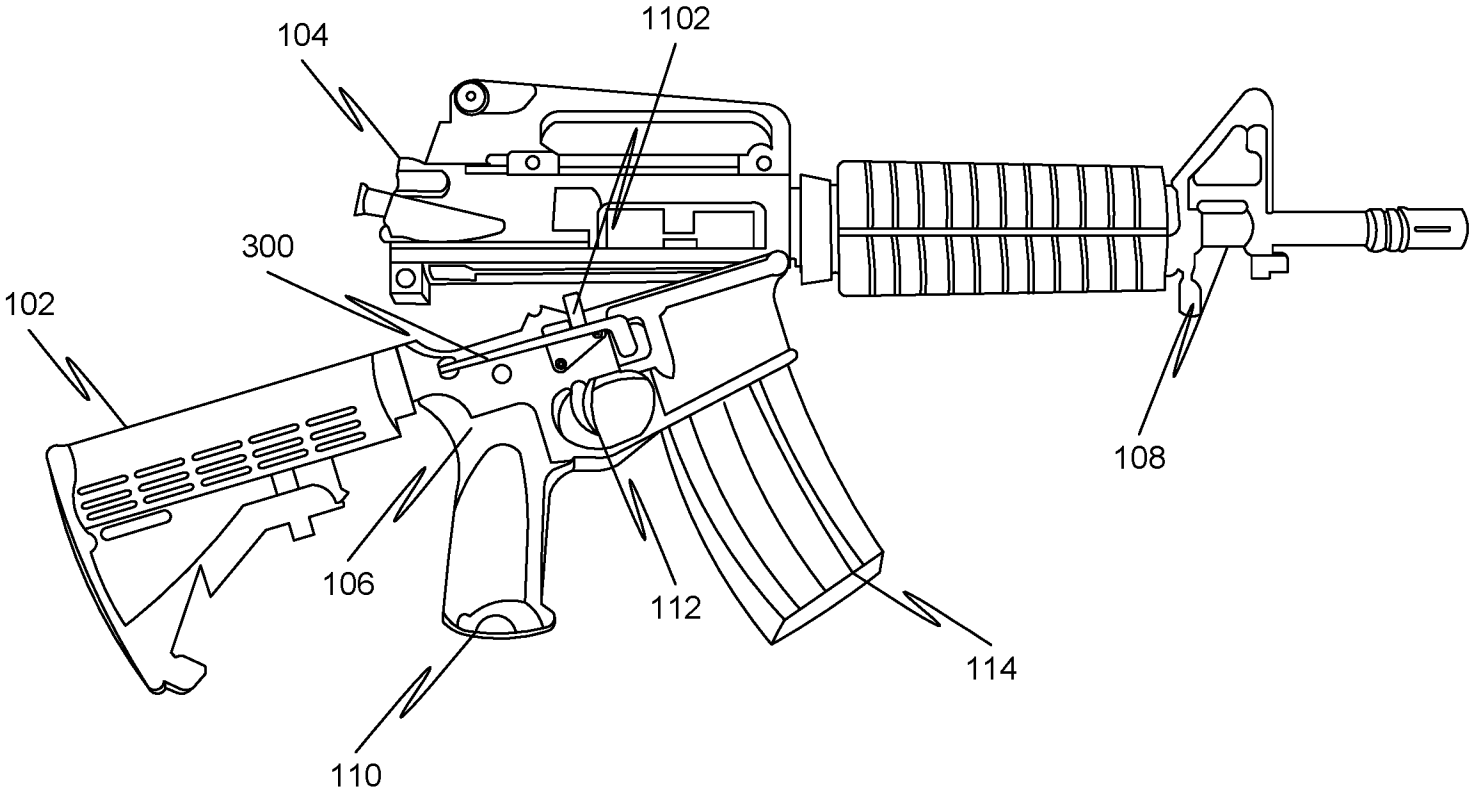
FIG. 13 illustrates a side view of the device of FIG. 11 attached to a firearm in a disassembled state.

According to an exemplary embodiment, FIG. 11 illustrates a side view of an upper tension bar 1102 (the disassemble mechanism) attached to the lever arm 304. A front view of the upper tension bar 1102 is shown in a circle 1104. As shown, the upper tension bar 1102 may be an L-shaped member, with a protrusion 1106 at one end 1108 of the upper tension bar 1102, wherein the other end 1110 may be attached to the lever arm 304. The protrusion 1106 may come in contact with the upper receiver 104 as shown in FIG. 12. The protrusion 1106 blocks the lever arm 304 from being depressed to the point of activating the magazine release mechanism, until the upper receiver 104 is separated from the lower receiver 106 by a predetermined distance. The predetermined distance may be related to requirements of the law regarding disassembling the firearm. As shown in FIG. 13, once the upper receiver 104 is separated from the lower receiver 106 by the predetermined distance, the protrusion 1106 loses contact with the upper receiver 104. Then, the upper tension bar 1102 allows the lever arm 304 to be depressed to the point of activating the magazine release mechanism.

Moreover, the upper tension bar 1102 may be configured to enable adjustment of one or both of a position and a length of the upper tension bar 1102. For example, one or both of the position and the length of the upper tension bar 1102 may be adjusted based on dimensions of the firearm 100. Further, the upper tension bar 1102 may include a telescoping member movable within an inner channel of the upper tension bar 1102 to change the length of the upper tension bar 1102. Further, the length and position of one or both segments of the L-shaped upper tension bar 1102 may be adjusted.

Figure 14:
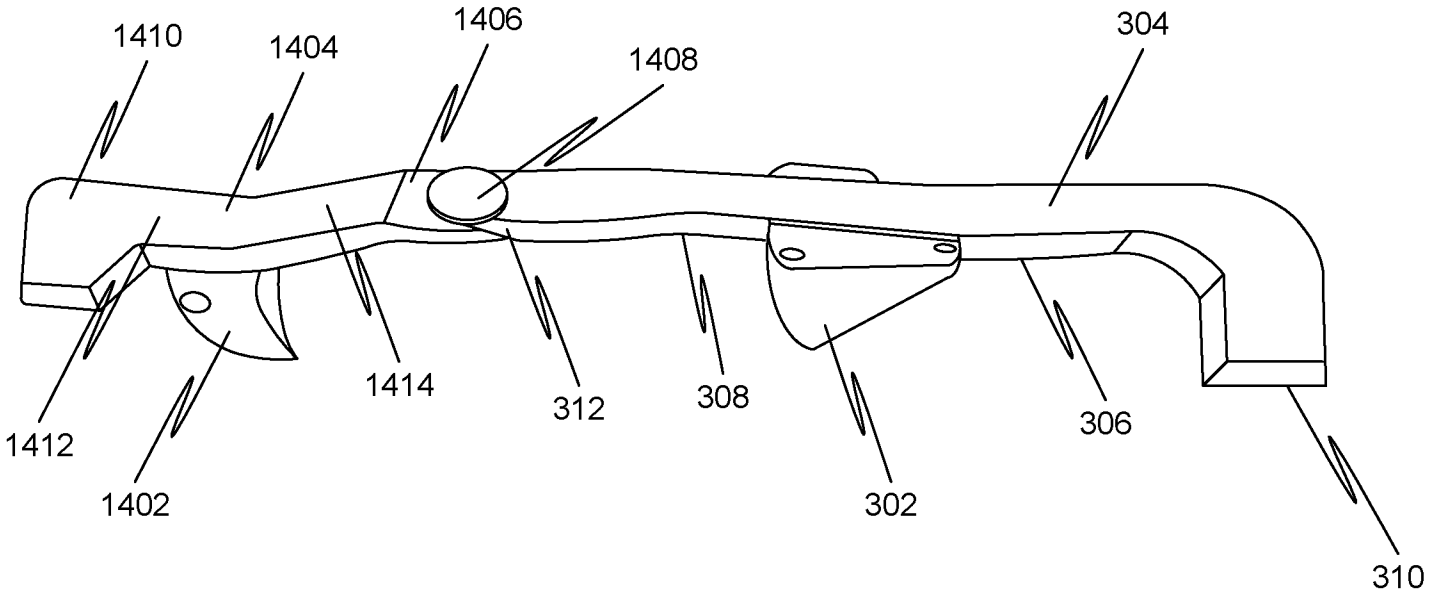
FIG. 14 illustrates a device for facilitating disassembly of a firearm and release of a magazine according to some embodiments.
Figure 15:
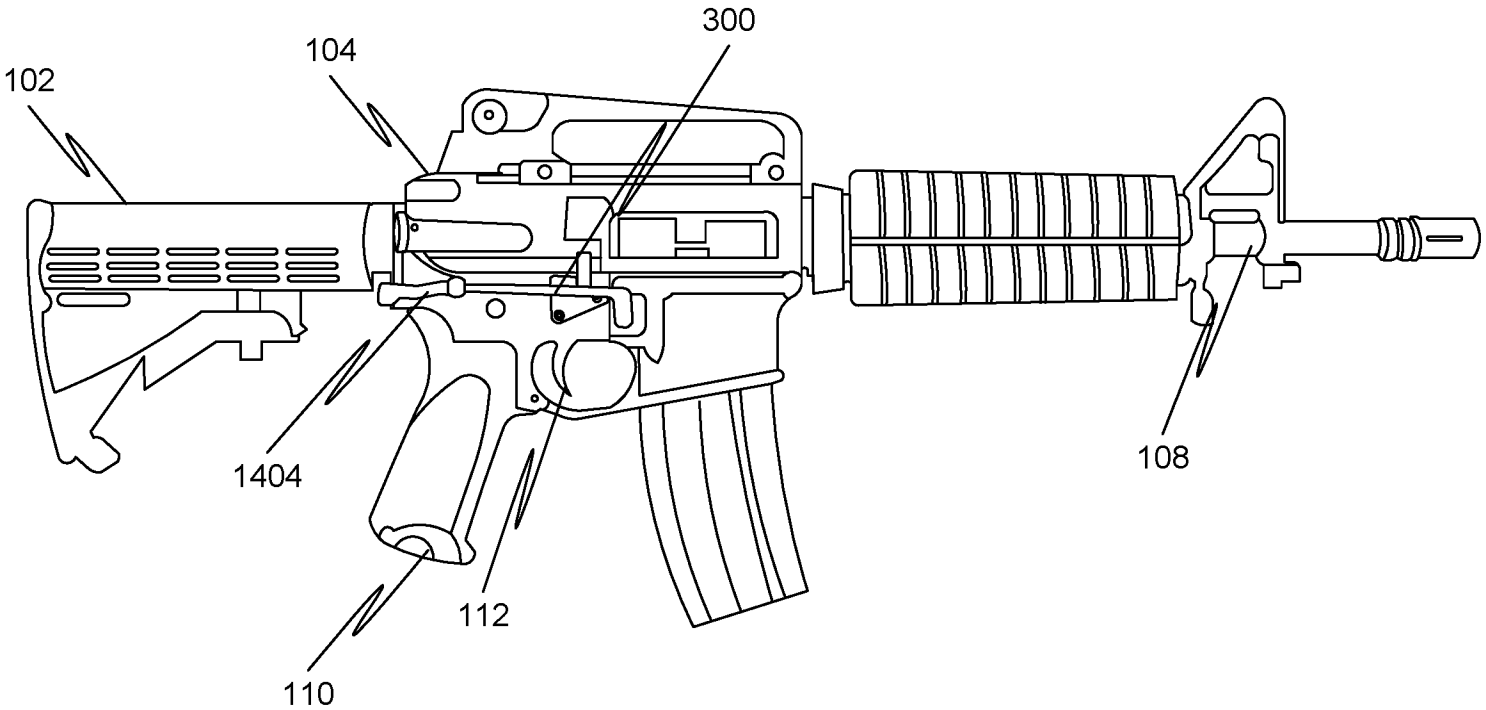
FIG. 15 illustrates the device of FIG. 14 attached to a firearm according to some embodiments.

FIG. 14 illustrates the device 300 according to an integration with other rear takedown pin release mechanisms. The illustrated examples of device 300's integration shows a Patriot Pin™, although many other rear takedown pin release mechanisms may be integrated with. In the example, the device 300 integrated with another fulcrum 1402 and an integrated lever arm 1404. The integrated lever arm 1404 may be configured to operationally engage with the fulcrum 1402, which may be attached to the firearm 100. The fulcrum 1402 and the integrated lever arm 1404 may be attached to the firearm 100 on the lower receiver 106. Further, the fulcrum 1402 and the integrated lever arm 1404 may be attached between the stock 102 and the rear takedown pin 118, as shown in FIG. 15. It should be understood that attachment locations may include, but not be limited to, the pistol grip, the trigger guard, the trigger, or any other location that enables the function described.

The integrated lever arm 1404 may include a first end 1406, which may be movably engaged with the second end 312 of the lever arm 304. For example, the first end 1406 may be engaged with the second end 312 using a pin 1408, such that the second end 312 may move along with the first end 1406.

Further, the integrated lever arm 1404 may include a second end 1410. A user may provide a first level depression of the integrated lever arm 1404 at the second end 1410. For example, the user may press the second end 1410 using their thumb to provide the first level depression of the integrated lever arm 1404. The user's pressing action may be met with a spring tension from a spring-like mechanism in the fulcrum 1402. In response to receiving the first level depression of the integrated lever arm 1404, the integrated lever arm 1404 may rotate on the fulcrum 1402, such that a first part 1412 of the integrated lever arm 1404 may move towards the firearm 100 and a second part 1414 of the integrated lever arm 1404 may move away the firearm 100. The first level depression of the integrated lever arm 1404 may be configured to cause a first function, which may include a displacement of the first end 1406 (and the pin 1408) of the integrated lever arm 1404. The displacement of the first end 1406 causes, in turn, to displace the second end 312 of the lever arm 304, which causes the rear takedown pin 118 to displace a proportional distance to release from the firearm, and lead the upper receiver 104 to disconnect from the lower receiver 106.

Thereafter, the user may provide a second level depression of the integrated lever arm 1404. For example, the user may keep pressing the second end 1410 using their thumb, after the first level depression of the integrated lever arm 1404 is received, to provide the second level depression of the integrated lever arm 1404. The second level depression of the integrated lever arm 1404 causes further displacement of the first end 1406 away from the firearm 100, which causes, in turn, to displace the second end 312 of the lever arm 304 away from the firearm 100. Therefore, the lever arm 304 rotates over the fulcrum 302, such that the first end 310 moves towards the firearm 100 (and the magazine release mechanism 116). The second-level depression may be configured to cause a second function subsequent to the first function, which may include activating the magazine release mechanism 116. For example, the magazine release mechanism 116 may be pressed to release the magazine 114.

Therefore, the device 300 (of FIG. 14) performs two sequential functions. A first function includes disassembling the firearm 100. The second function includes activating the magazine release mechanism 116. In this way, the upper receiver is disassembled from the lower receiver prior to the depression of the magazine release button. Further, the device 300 may be configured to enable disassembly of the firearm 100 and release of the magazine 114 to occur based on a single contiguous motion of the lever arms 304 and 1404.

In another embodiment, the device 300 for facilitating disassembly of the firearm 100 and release of the magazine 114 may include the fulcrum 302, the lever arm 304 and the limiter 1002. The fulcrum 302 may be configured to be attached to the firearm 100. The lever arm 304 may be configured to operationally engage with the fulcrum 302. A first part of the lever arm 304 may be operationally engaged with the rear takedown pin 118. A second part of the lever arm 304 may be operationally engaged with the magazine release mechanism. The actuation of the lever arm 304 may displace the rear takedown pin 118 and actuate the magazine release mechanism, wherein displacement of the rear takedown pin 118 may result in disassembly of the upper receiver 104 from the lower receiver 106. The disassembly of the upper receiver 104 from the lower receiver 106 occurs prior to actuation of the magazine release mechanism. The limiter 1002 may be to restrict separation of the upper receiver 104 from the lower receiver 106 beyond a predetermined distance upon disassembly of the upper receiver 104 from the lower receiver 106. The device 300 may enable disassembly and release of the magazine 114 to occur based on a single contiguous motion of the lever arm 304.

In another embodiment, the device 300 for facilitating disassembly of the firearm 100 and release of the magazine 114 may include the fulcrum 302, the lever arm 304, and the upper tension bar 1102. The fulcrum 302 may be configured to be attached to the firearm 100. The lever arm 304 may be configured to operationally engage with the fulcrum 302. A first part of the lever arm 304 may be operationally engaged with the rear takedown pin 118. A second part of the lever arm 304 may be operationally engaged with the magazine release mechanism. The actuation of the lever arm 304 may displace the rear takedown pin 118 and actuate the magazine release mechanism, wherein displacement of the rear takedown pin 118 may result in disassembly of the upper receiver 104 from the lower receiver 106. The disassembly of the upper receiver 104 from the lower receiver 106 occurs prior to actuation of the magazine release mechanism. The upper tension bar 1102 may be configured to be attached to the lever arm 304. Further, the upper tension bar 304 may be configured to prevent actuation of the magazine release mechanism based on actuation of the lever arm 304 until a separation between the upper receiver 104 and the lower receiver 106 reaches a predetermined distance. The device 300 may enable disassembly and release of the magazine 115 to occur based on a single contiguous motion of the lever arm 304.

In yet another embodiment, the device 300 for facilitating disassembly of the firearm 100 and release of the magazine 114 may include the fulcrum 302, the lever arm 304, the limiter 1002 and the upper tension bar 1102. The fulcrum 302 may be configured to be attached to the firearm 100. The lever arm 304 may be configured to operationally engage with the fulcrum 302. A first part of the lever arm 304 may be operationally engaged with the rear takedown pin 118. A second part of the lever arm 304 may be operationally engaged with the magazine release mechanism. The actuation of the lever arm 304 may displace the rear takedown pin 118 and actuate the magazine release mechanism, wherein displacement of the rear takedown pin 118 may result in disassembly of the upper receiver 104 from the lower receiver 106. The disassembly of the upper receiver 104 from the lower receiver 106 occurs prior to actuation of the magazine release mechanism. The limiter 1002 may be configured to restrict separation of the upper receiver 104 from the lower receiver 106 beyond a predetermined distance upon disassembly of the upper receiver 104 from the lower receiver 106. The upper tension bar 1102 may be configured to be attached to the lever arm 304. Further, the upper tension bar 1102 may be configured to prevent actuation of the magazine release mechanism based on actuation of the lever arm 304 until a separation between the upper receiver 104 and the lower receiver 106 reaches a predetermined distance. The device 300 may enable disassembly and release of the magazine 114 to occur based on a single contiguous motion of the lever arm 304.

IV. Aspects

The following aspects may be claimed in the present application.

1. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:

a fulcrum configured to be attached to the firearm; and a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism.

2. The device of aspect 1, configured to enable disassembly and release of the magazine to occur based on a single contiguous motion of the lever arm.
3. The device of aspect 1, wherein the first part of the lever arm comprises the first end of the lever arm, wherein the second part of the lever arm comprises a second end of the lever arm, wherein the first end is opposite to the second end.
4. The device of aspect 1, wherein the fulcrum is configured to be installed on the firearm at a location in between the rear takedown pin and the magazine release mechanism.
5. The device of aspect 1, wherein the magazine release mechanism comprises at least one from the following group: an encasement, a magazine release button, and an aftermarket add-on configuration of the magazine release button.
6. The device of aspect 1, further comprising a limiter configured to restrict separation of the upper receiver from the lower receiver beyond a predetermined distance upon disassembly of the upper receiver from the lower receiver.
7. The device of aspect 1, further comprising an upper tension bar configured to prevent actuation of the magazine release mechanism based on actuation of the lever arm until a separation between the upper receiver and the lower receiver reaches a predetermined distance.
8. The device of aspect 7, wherein the upper tension bar is configured to enable adjustment of at least one of a position and a length of the upper tension bar.
9. The device of aspect 1, wherein the disassembly of the upper receiver from the lower receiver prevents firing of the firearm upon pulling a trigger comprised in the firearm.
10. The device of aspect 1, wherein the firearm is AR-15.
11. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:
   a fulcrum configured to be attached to the firearm;
   a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism; and
   a limiter configured to restrict separation of the upper receiver from the lower receiver beyond a predetermined distance upon disassembly of the upper receiver from the lower receiver.
12. The device of aspect 11, configured to enable disassembly and release of the magazine to occur based on a single contiguous motion of the lever arm.
13. The device of aspect 11, wherein the magazine release mechanism comprises at least one from the following group: an encasement, a magazine release button, and an aftermarket add-on configuration of the magazine release button.
14. The device of aspect 11, further comprising an upper tension bar configured to prevent actuation of the magazine release mechanism based on actuation of the lever arm until a separation between the upper receiver and the lower receiver reaches a predetermined distance.
15. The device of aspect 14, wherein the upper tension bar is configured to enable adjustment of at least one of a position and a length of the upper tension bar.
16. The device of aspect 11, wherein the disassembly of the upper receiver from the lower receiver prevents firing of the firearm upon pulling a trigger comprised in the firearm.
17. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:
   a fulcrum configured to be attached to the firearm;
   a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism; and
   an upper tension bar configured to prevent actuation of the magazine release mechanism based on actuation of the lever arm until a separation between the upper receiver and the lower receiver reaches a predetermined distance.
18. The device of aspect 17, configured to enable disassembly and release of the magazine to occur based on a single contiguous motion of the lever arm, wherein the disassembly of the upper receiver from the lower receiver prevents firing of the firearm upon pulling a trigger comprised in the firearm.
19. The device of aspect 17, wherein the magazine release mechanism comprises at least one from the following group: an encasement, a magazine release button, and an aftermarket add-on configuration of the magazine release button.
20. The device of aspect 17, wherein the upper tension bar is configured to enable adjustment of at least one of a position and a length of the upper tension bar.
21. The device of aspect 17, further includes a limiter configured to restrict separation of the upper receiver from the lower receiver beyond a predetermined distance upon disassembly of the upper receiver from the lower receiver.
22. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:

a fulcrum configured to be attached to the firearm;

a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism;

a limiter configured to restrict separation of the upper receiver from the lower receiver beyond a predetermined distance upon disassembly of the upper receiver from the lower receiver; and an upper tension bar configured to be attached to the lever arm, wherein the upper tension bar is configured to prevent actuation of the magazine release mechanism based on actuation of the lever arm until a separation between the upper receiver and the lower receiver reaches a predetermined distance.

23. The device of aspect 17, configured to enable disassembly and release of the magazine to occur based on a single contiguous motion of the lever arm, wherein the disassembly of the upper receiver from the lower receiver prevents firing of the firearm upon pulling a trigger comprised in the firearm.

24. The device of aspect 17, wherein the magazine release mechanism comprises at least one from the following group: an encasement, a magazine release button, and an aftermarket add-on configuration of the magazine release button.

25. The device of aspect 17, wherein the upper tension bar is configured to enable adjustment of at least one of a position and a length of the upper tension bar.

26. A method for facilitating disassembly of a firearm and release of a magazine removably attached to the firearm, wherein the firearm comprising an upper receiver, a lower receiver, a rear takedown pin and a magazine release mechanism, the method comprising:

receiving a first level depression of a lever arm of the firearm, wherein the firearm further comprises a device with a fulcrum and a lever arm attached to the fulcrum, wherein one end of the lever arm is near the rear takedown pin and the other end is near the magazine release mechanism;

causing the rear takedown pin to be released and the upper receiver to disconnect from the lower receiver;

receiving a second level of depression of the lever arm; and causing the magazine release mechanism to be activated.

27. The method of aspect 26, further comprises restricting a separation of the upper receiver from the lower receiver, with a limiter, beyond a predetermined distance upon disassembly of the upper receiver from the lower receiver.

28. The method of aspect 26, further comprising preventing, by an upper tension rod, an actuation of the magazine release mechanism based on actuation of the lever arm until a separation between the upper receiver and the lower receiver reaches a predetermined distance.

29. The method of aspect 26, wherein the disassembly and release of the magazine occurs based on a single contiguous motion of the lever arm, wherein the disassembly of the upper receiver from the lower receiver prevents firing of the firearm upon pulling a trigger comprised in the firearm.

30. The method of aspect 26, wherein the magazine release mechanism comprises at least one from the following group: an encasement, a magazine release button, and an aftermarket add-on configuration of the magazine release button.

31. The method of aspect 26, further comprising enabling an adjusting of at least one position and length of the upper tension bar.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:

a fulcrum configured to be attached to the firearm; and a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism.

2. The device of claim 1, configured to enable disassembly and release of the magazine to occur based on a single contiguous motion of the lever arm.

3. The device of claim 1, wherein the first part of the lever arm comprises the first end of the lever arm, wherein the second part of the lever arm comprises a second end of the lever arm, wherein the first end is opposite to the second end.

4. The device of claim 1, wherein the fulcrum is configured to be installed on the firearm at a location in between the rear takedown pin and the magazine release mechanism.

5. The device of claim 1, wherein the magazine release mechanism comprises at least one from the following group: an encasement, a magazine release button, and an aftermarket add-on configuration of the magazine release button.

6. The device of claim 1, further comprising a limiter configured to restrict separation of the upper receiver from the lower receiver beyond a predetermined distance upon disassembly of the upper receiver from the lower receiver.

7. The device of claim 1, further comprising an upper tension bar configured to prevent actuation of the magazine release mechanism based on actuation of the lever arm until a separation between the upper receiver and the lower receiver reaches a predetermined distance.

8. The device of claim 7, wherein the upper tension bar is configured to enable adjustment of at least one of a position and a length of the upper tension bar.

9. The device of claim 1, wherein the disassembly of the upper receiver from the lower receiver prevents firing of the firearm upon pulling a trigger comprised in the firearm.

10. The device of claim 1, wherein the firearm is AR-15.

11. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:

a fulcrum configured to be attached to the firearm;

a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism; and a limiter configured to restrict separation of the upper receiver from the lower receiver beyond a predetermined distance upon disassembly of the upper receiver from the lower receiver.

12. The device of claim 11, configured to enable disassembly and release of the magazine to occur based on a single contiguous motion of the lever arm.

13. The device of claim 11, wherein the magazine release mechanism comprises at least one from the following group: an encasement, a magazine release button, and an aftermarket add-on configuration of the magazine release button.

14. A device for facilitating disassembly of a firearm and release of a magazine removably attached to the firearm, wherein the firearm comprises an upper receiver, a lower receiver, a rear takedown pin and a magazine release mechanism, wherein the rear takedown pin is configured to secure the upper receiver to the lower receiver, wherein the magazine release mechanism is configured to release the magazine from the firearm based on actuation of the magazine release mechanism, the device comprising:

a fulcrum configured to be attached to the firearm;

a lever arm configured to operationally engage with the fulcrum, wherein a first part of the lever arm is operationally engaged with the rear takedown pin, wherein a second part of the lever arm is operationally engaged with the magazine release mechanism, wherein actuation of the lever arm displaces the rear takedown pin and actuates the magazine release mechanism, wherein displacement of the rear takedown pin results in disassembly of the upper receiver from the lower receiver, wherein disassembly of the upper receiver from the lower receiver occurs prior to actuation of the magazine release mechanism;

a limiter configured to restrict separation of the upper receiver from the lower receiver beyond a predetermined distance upon disassembly of the upper receiver from the lower receiver; and an upper tension bar configured to be attached to the lever arm, wherein the upper tension bar is configured to prevent actuation of the magazine release mechanism based on actuation of the lever arm until a separation between the upper receiver and the lower receiver reaches a predetermined distance.

15. The device of claim 14, configured to enable disassembly and release of the magazine to occur based on a single contiguous motion of the lever arm.

16. The device of claim 14, wherein the magazine release mechanism comprises at least one from the following group: an encasement, a magazine release button, and an aftermarket add-on configuration of the magazine release button.

17. The device of claim 14, wherein the upper tension bar is configured to enable adjustment of at least one of a position and a length of the upper tension bar.

18. A method for facilitating disassembly of a firearm and release of a magazine removably attached to the firearm, wherein the firearm comprising an upper receiver, a lower receiver, a rear takedown pin and a magazine release mechanism, the method comprising:

receiving a first level depression of a lever arm of the firearm, wherein the firearm further comprises a device with a fulcrum and a lever arm attached to the fulcrum, wherein one end of the lever arm is near the rear takedown pin and the other end is near the magazine release mechanism;

causing the rear takedown pin to be released and the upper receiver to at least partially disengage from the lower receiver;

receiving a second level of depression of the lever arm; and causing the magazine release mechanism to be activated.

19. The method of claim 18, further comprises restricting a separation of the upper receiver from the lower receiver, with a limiter, beyond a predetermined distance upon disassembly of the upper receiver from the lower receiver.

20. The method of claim 18, further comprising preventing, by an upper tension rod, an actuation of the magazine release mechanism based on actuation of the lever arm until a separation between the upper receiver and the lower receiver reaches a predetermined distance.

21. The method of claim 18, wherein the disassembly and release of the magazine occurs based on a single contiguous motion of the lever arm, wherein the disassembly of the upper receiver from the lower receiver prevents firing of the firearm upon pulling a trigger comprised in the firearm.

22. The method of claim 18, wherein the magazine release mechanism comprises at least one from the following group: an encasement, a magazine release button, and an aftermarket add-on configuration of the magazine release button.

23. The method of claim 18, further comprising enabling an adjusting of at least one position and length of the upper tension bar.

* * * * *